US007591770B2

(12) United States Patent
Stewart et al.

(10) Patent No.: US 7,591,770 B2
(45) Date of Patent: Sep. 22, 2009

(54) PRESS STATION WITH ADD-ON WEIGHTS

(75) Inventors: Jonathan M. Stewart, Seattle, WA (US); Edward R. Burns, Kirkland, WA (US)

(73) Assignee: Precor Incorporated, Woodinville, WA (US)

( * ) Notice: Subject to any disclaimer, the term of this patent is extended or adjusted under 35 U.S.C. 154(b) by 611 days.

(21) Appl. No.: 10/968,752

(22) Filed: Oct. 19, 2004

(65) Prior Publication Data

US 2005/0054495 A1 Mar. 10, 2005

Related U.S. Application Data

(63) Continuation-in-part of application No. 10/465,126, filed on Jun. 18, 2003, now Pat. No. 7,090,623.

(51) Int. Cl.
*A63B 21/062* (2006.01)

(52) U.S. Cl. ..... 482/99; 482/100

(58) Field of Classification Search ..... 482/92–94, 482/98–103, 136–138, 908
See application file for complete search history.

(56) References Cited

U.S. PATENT DOCUMENTS

| | | | | |
|---|---|---|---|---|
| 323,792 | A * | 8/1885 | Coop et al. | 482/102 |
| 4,538,805 | A * | 9/1985 | Parviainen | 482/98 |
| 4,627,615 | A | 12/1986 | Nurkowski | 272/118 |
| 4,712,793 | A * | 12/1987 | Harwick et al. | 482/99 |
| 4,817,943 | A | 4/1989 | Pipasik | 272/117 |
| 4,834,365 | A * | 5/1989 | Jones | 482/100 |
| 4,971,305 | A * | 11/1990 | Rennex | 482/93 |
| 5,135,453 | A | 8/1992 | Sollenberger et al. | 482/101 |
| 5,429,569 | A * | 7/1995 | Gunnari et al. | 482/100 |
| 5,643,152 | A | 7/1997 | Simonson | 482/100 |
| 5,776,040 | A | 7/1998 | Webb et al. | 482/98 |
| 5,935,048 | A | 8/1999 | Krull | 482/98 |
| 5,944,642 | A | 8/1999 | Krull | 482/98 |
| 6,387,018 | B1 | 5/2002 | Krull | 482/98 |
| 6,387,019 | B1 | 5/2002 | Krull | 482/98 |

(Continued)

FOREIGN PATENT DOCUMENTS

CA 2297577 A1 3/2001

(Continued)

*Primary Examiner*—Loan H Thanh
*Assistant Examiner*—Victor K Hwang
(74) *Attorney, Agent, or Firm*—Terence P. O'Brien; Paul Schaafsma; Todd A. Rathe

(57) ABSTRACT

An exercise apparatus for performing press exercises is provided. The exercise apparatus includes a frame and a support assembly adjustably coupled to the frame. A first press arm is coupled to the support assembly and is pivotal about a first pivot axis between a rest position and an extended position. A mechanism for add-on weights is further provided. The mechanism for add-on weights includes at least one add-on weight having a first region of contact and a second region of contact. The first region of contact can be defined by a selector pin hole in the add-on weight adapted to receive a selector pin. The selector pin engages the add-on weight approximately in line with the center of gravity of the add-on weight. The second region of contact can be provided by a stabilization bracket defining an aperture into which a stabilization pin on the add-on weight extends.

20 Claims, 11 Drawing Sheets

U.S. PATENT DOCUMENTS

| | | | | |
|---|---|---|---|---|
| 6,387,021 | B1 | 5/2002 | Miller, Jr. | 482/99 |
| 6,468,189 | B2 * | 10/2002 | Alessandri | 482/99 |
| 6,497,639 | B2 | 12/2002 | Webber et al. | 482/98 |
| 6,629,910 | B1 * | 10/2003 | Krull | 482/98 |
| 6,666,800 | B2 | 12/2003 | Krull | 482/94 |
| 7,011,609 | B1 * | 3/2006 | Kuo | 482/94 |
| 7,090,623 | B2 * | 8/2006 | Stewart et al. | 482/100 |
| 7,252,627 | B2 * | 8/2007 | Carter | 482/98 |
| 7,335,139 | B2 * | 2/2008 | Bartholomew et al. | 482/97 |
| 7,413,532 | B1 * | 8/2008 | Monsrud et al. | 482/99 |
| 2002/0049123 | A1 | 4/2002 | Krull | 482/98 |
| 2002/0151413 | A1 | 10/2002 | Dalebout et al. | 482/54 |
| 2003/0040407 | A1 | 2/2003 | Rothacker | 482/106 |
| 2003/0092542 | A1 | 5/2003 | Bartholomew et al. | 482/99 |
| 2006/0205571 | A1 * | 9/2006 | Krull | 482/94 |
| 2006/0217245 | A1 * | 9/2006 | Golesh et al. | 482/94 |

FOREIGN PATENT DOCUMENTS

| | | | | |
|---|---|---|---|---|
| DE | 202004006399 | U1 | * | 7/2004 |
| DE | 10 2004 029 509 | A1 | | 1/2005 |
| EP | 1031359 | A1 | * | 8/2000 |
| FR | 1 304 844 | A | | 9/1962 |
| JP | 10118222 | A | * | 5/1998 |
| SU | 1347948 | A | * | 10/1987 |
| SU | 1644983 | A | * | 4/1991 |
| SU | 1766429 | A1 | | 10/1992 |
| WO | WO 95/00210 | | | 1/1995 |
| WO | WO 2005009547 | A1 | * | 2/2005 |

* cited by examiner

PRESS STATION WITH ADD-ON WEIGHTS

RELATED APPLICATION

This application is a continuation-in-part of U.S. patent application Ser. No. 10/465,126 titled "Press Station with Adjustable, Various Path Feature" filed on Jun. 18, 2003 and issued on Aug. 15, 2006 as U.S. Pat. No. 7,090,623.

FIELD OF THE INVENTION

The present invention related generally to the field of exercise and physical rehabilitation equipment, and more particularly, to exercise apparatuses for exercising the muscles of a user.

BACKGROUND OF THE INVENTION

The benefits of muscle exercises of a user are well known. For example, press exercises directed at the strengthening of the muscles of the upper torso after injury or surgery are well known in their ability to strengthen the muscles, to prevent atrophy of the muscles, and return the muscles to normal operation. Further, press exercises are well known for their ability to increase performance, strength, and/or enhance the appearance of one's body. Various press exercises have been developed to exercise the muscles of the upper torso, most of which involve contracting and/or extending one's arms against a resistant force, the resistant force provided by an exercise apparatus.

Although previously developed press exercise apparatuses are effective, they are not without drawbacks. In a typical embodiment of prior art press exercise apparatuses, a pair of press arms is coupled to a load-bearing assembly, such as a stack of weights. In operation, the user grasps a handle of each press arm and presses the handles outward from the chest of the user to exercise the muscles of the upper torso. Inasmuch as the press arms are restricted to paths extending perpendicularly outward from the chest, the press exercise apparatus does not allow the user's hands to move inward toward one another during the exercise, in a more natural motion.

A few of the previously developed press exercise apparatuses have addressed this limitation by permitting inward movement of the press arms along a single selected, predetermined path. However, these press exercise apparatuses are not without drawbacks. For instance, although the press exercise apparatuses allow inward movement, they do not allow the user to configure the press exercise apparatus such that press arms will follow a specific predetermined path selected from a multitude of different predetermined paths. Thus, the user is unable to choose a specific predetermined path that provides optimum comfort, a desired focus of the exercise upon a specific muscle or portion of a muscle, or an optimum orientation of the predetermined path relative to the specific body size of the user.

Prior art press exercise apparatuses often permit a user to adjust a position of a seat in relation to a rest position of the press arms. Further, prior art press exercise apparatuses permit the adjustment of the positions of the rest position of the press arms. In some of these devices, however, a user must separately adjust the position of the seat and the rest position of the press arms, resulting in an iterative adjustment process. More specifically, when a user adjusts the position of the seat, the user's orientation relative to the rest position of the press arms is changed, thereby necessitating the user to readjust the rest position of the press arms. Once the rest position of the press arms is changed, the readjustment of the seat position may be necessary. Thus, such adjustment can be an iterative process that can be awkward, time consuming, and frustrating for a user.

Prior art exercise apparatuses often utilize adjustment mechanisms for adjusting a separation distance between a first part of the apparatus and a second part of the apparatus, to adjust some aspect of the operation of the press exercise apparatus. While permitting a separation distance between a first part and a second part to be varied, prior art adjustment mechanisms permit the distance to be varied even when the adjustment mechanism is under a load. Thus, when a user manipulates the adjustment mechanism to alter the separation distance, the load can be suddenly and undesirably released. U.S. patent application Ser. No. 10/465,126 titled "Press Station with Adjustable, Various Path Feature" filed on Jun. 18, 2003 addresses these drawbacks.

Additionally, prior art exercise apparatuses often provide for the addition of add-on weights having weight increments between the weight increments provided for by the exercise apparatus. For example, it is typical for the weights of such exercise apparatus to incorporate fairly large weights, for example 10 lb weight increments. Add-on weights that are not integrally incorporated with the exercise apparatus can be provided having intermediary increments of, for example, 2.5 lbs, 5 lbs, and 7.5 lbs. Thus, the user is not restricted to choosing weight increments of, in this example, 10 lbs.

One drawback of prior art exercise apparatuses is that the add-on weights on prior art apparatuses are not intended to be stored in a rack but typically lie loosely on the floor, requiring the user to take the time to find the correct weight, pick up the weights from the floor, and install them on the device. Another drawback of prior art exercise apparatuses is that the add-on weights on prior art apparatus were loosely added without sufficient support and therefore were prone to movement or dislocation during the exercise routine and were easily lost. An additional drawback of prior art exercise apparatuses is that the add-on weights on prior art apparatus upset of the balance of the weights of such exercise apparatus with respect to the mechanisms that connect the weights to the user. One attempt to address these drawbacks has been the use of guided add-on weights that are guided in a track. The drawbacks of this type of approach include complication of structure, additional of costs, and the possibility that the frictional engagement of the guide tracks will alter the applied weight to the user.

What would thus be desirable is for an exercise apparatus that provide a mechanism for add-on weights. Such add-on weight mechanism should be convenient to use. Such add-on weight mechanism should be added with sufficient support to minimize movement during the exercise routine and preclude lost weights. Such add-on weight mechanism should not upset the balance of the weights of such exercise apparatus with respect to the mechanisms that connect the weights to the user. Such add-on weight mechanism should avoid the use of add-on weights that are guided in a track. Such add-on weight mechanism should be provided with a simplicity of structure, little addition of costs, and avoid the possibility that the frictional engagement of the add-on weights will alter the applied weight to the user.

SUMMARY OF THE INVENTION

An exercise apparatus in accordance with the principles of the present invention provides a mechanism for add-on weights. A mechanism for add-on weights in accordance with the principles of the present invention is convenient to use. A mechanism for add-on weights in accordance with the principles of the present invention does not upset the balance of the weights of such exercise apparatus with respect to the mechanisms that connect the weights to the user. A mechanism for add-on weights of the present invention avoids the use of add-on weights that are guided in a track. A mechanism for add-on weights of the present invention provides simplicity of structure, has little addition of costs, and avoids the possibility that the frictional engagement of the add-on weights will alter the applied weight to the user.

In accordance with the principles of the present invention, an exercise apparatus for performing press exercises is provided. The exercise apparatus includes a frame and a support assembly adjustably coupled to the frame. A first press arm is coupled to the support assembly and is pivotal about a first pivot axis between a rest position and an extended position. A mechanism for add-on weights is further provided. The mechanism for add-on weights includes at least one add-on weight having a first region of contact and a second region of contact. The first region of contact can be defined by a selector pinhole in the add-on weight adapted to receive a selector pin. The selector pin engages the add-on weight approximately in line with the center of gravity of the add-on weight. The second region of contact can be provided by a stabilization bracket defining an aperture into which a stabilization pin on the add-on weight extends. The mechanism for add-on weights in accordance with the present invention provides add-on weights without a guide track that adds-on at least one additional load.

BRIEF DESCRIPTION OF THE DRAWINGS

The foregoing aspects and many of the attendant advantages of this invention will become better understood by reference to the following detailed description, when taken in conjunction with the accompanying drawings, wherein.

DETAILED DESCRIPTION OF A PREFERRED EMBODIMENT

Figure 1:
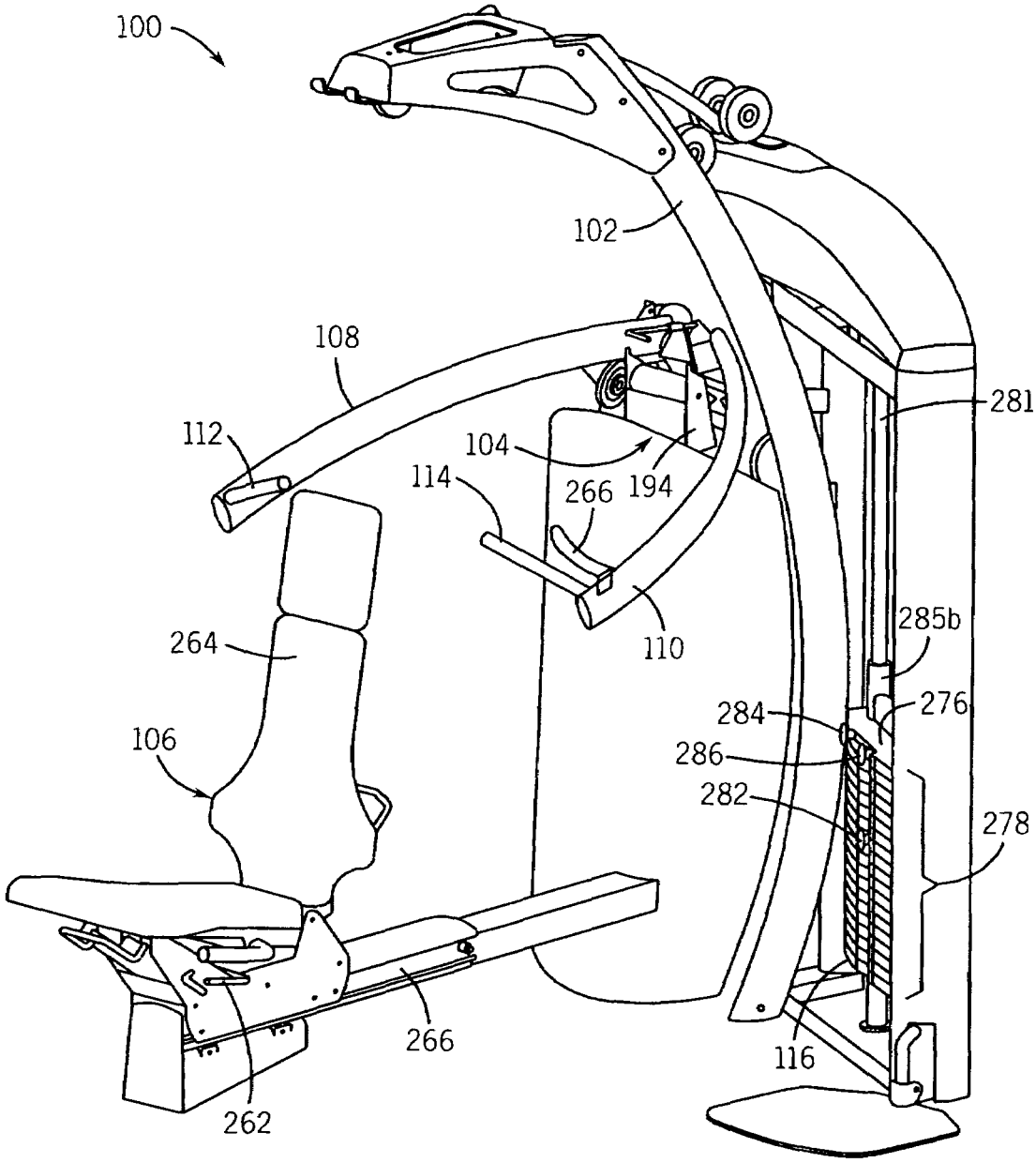
FIG. 1 is a perspective view of one embodiment of an exercise apparatus in accordance with present invention.

Referring to FIG. 1, one embodiment of an exercise apparatus 100 formed in accordance with the present invention is seen. The exercise apparatus 100 is adjustable to provide a plurality of exercises for strengthening and toning muscles of a user. The exercise apparatus 100 includes a frame 102 with a press assembly 104 and a seat 106 mounted thereto. The press assembly 104 includes a first press arm 108 and a second press arm 110, both pivotally coupled to the frame 102.

The press arms 108, 110 each include a handle 112, 114. A user may grasp the handles 112, 114 while sitting in the seat 106 and press upwardly and/or outward on the handles 112, 114, thereby rotating the press arms 108, 110 relative to the frame 102. A load-bearing assembly 116, such as weights 276, 278, is coupled to the press arms 108, 110 to provide resistance to the user's rotation of the press arms 108, 110. Although a specific a load-bearing assembly 116 is shown in the illustrated embodiment, it should be apparent to those skilled in the art that alternate load-bearing sources, such as resistance sources based on electricity, friction, air movement, elastic forces, spring forces, magnets, or other resistance sources known in the art are suitable for use with and within the scope of the present invention. The weights 276, 278 are coupled to the press arms 108, 110 to provide resistance to the user's rotation of the press arms 108 through a series of cables and pulleys as know in the art. The weights 276, 278 are vertically stacked and are movably mounted to the frame 102 of the exercise apparatus 100 by guiding apparatus, such as for example, a pair of guide rods 281, 283. Bushings 285*a*, 285*b* can be mounted on the first weight to encourage proper alignment of the first weight and the additional weights on the guide rods 281, 283. As will be explained in more detail, below, the amount of weight is selected by use of a plurality of selector members. In the preferred embodiment, the selector members are selector pins 282, 284, 286.

Figure 8:
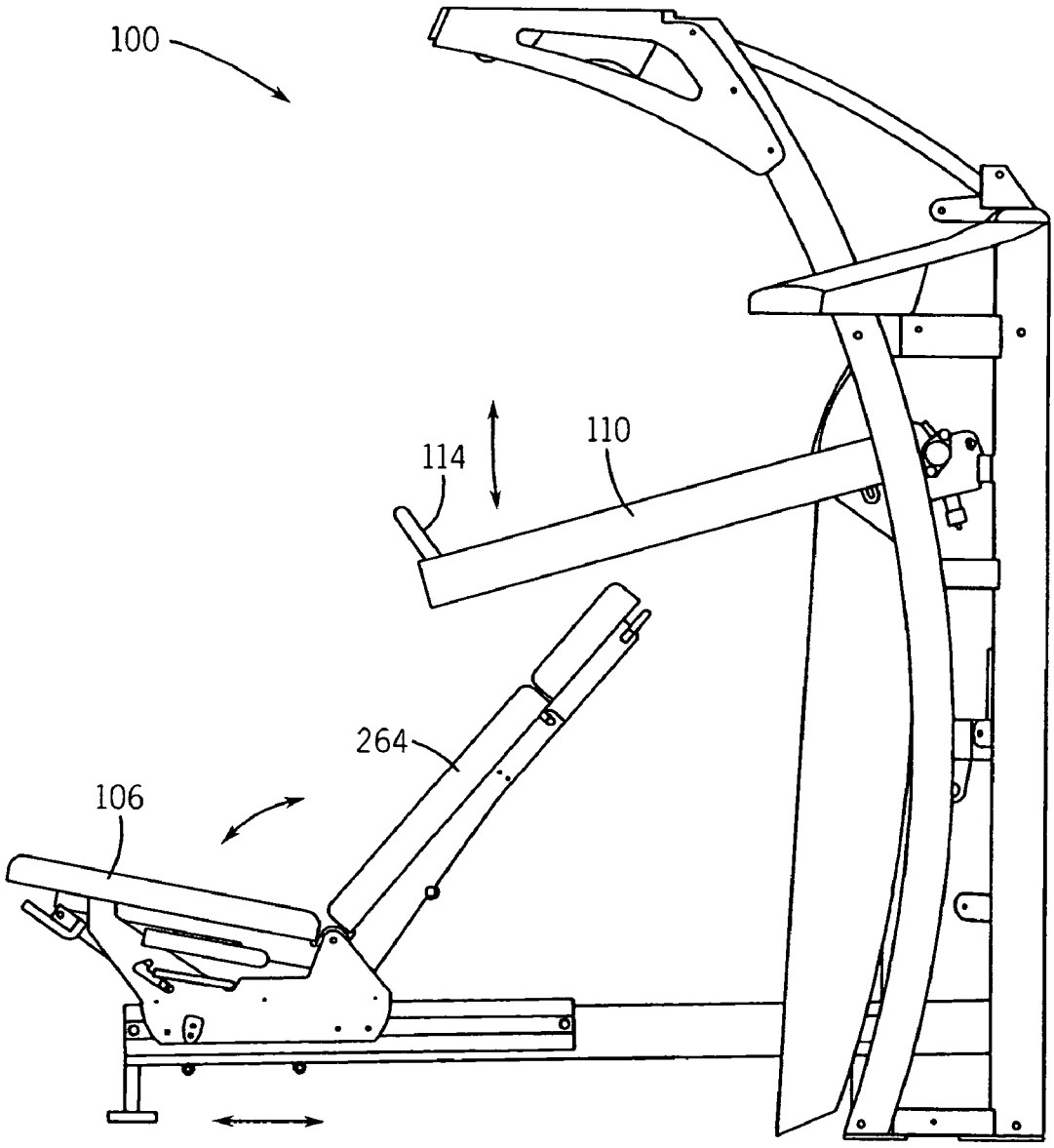
FIG. 8 is a side view of the exercise apparatus depicted in FIG. 6, the press arms being in a first rest position where the handles are suspended at the first elevation above the seat.
Figure 9:
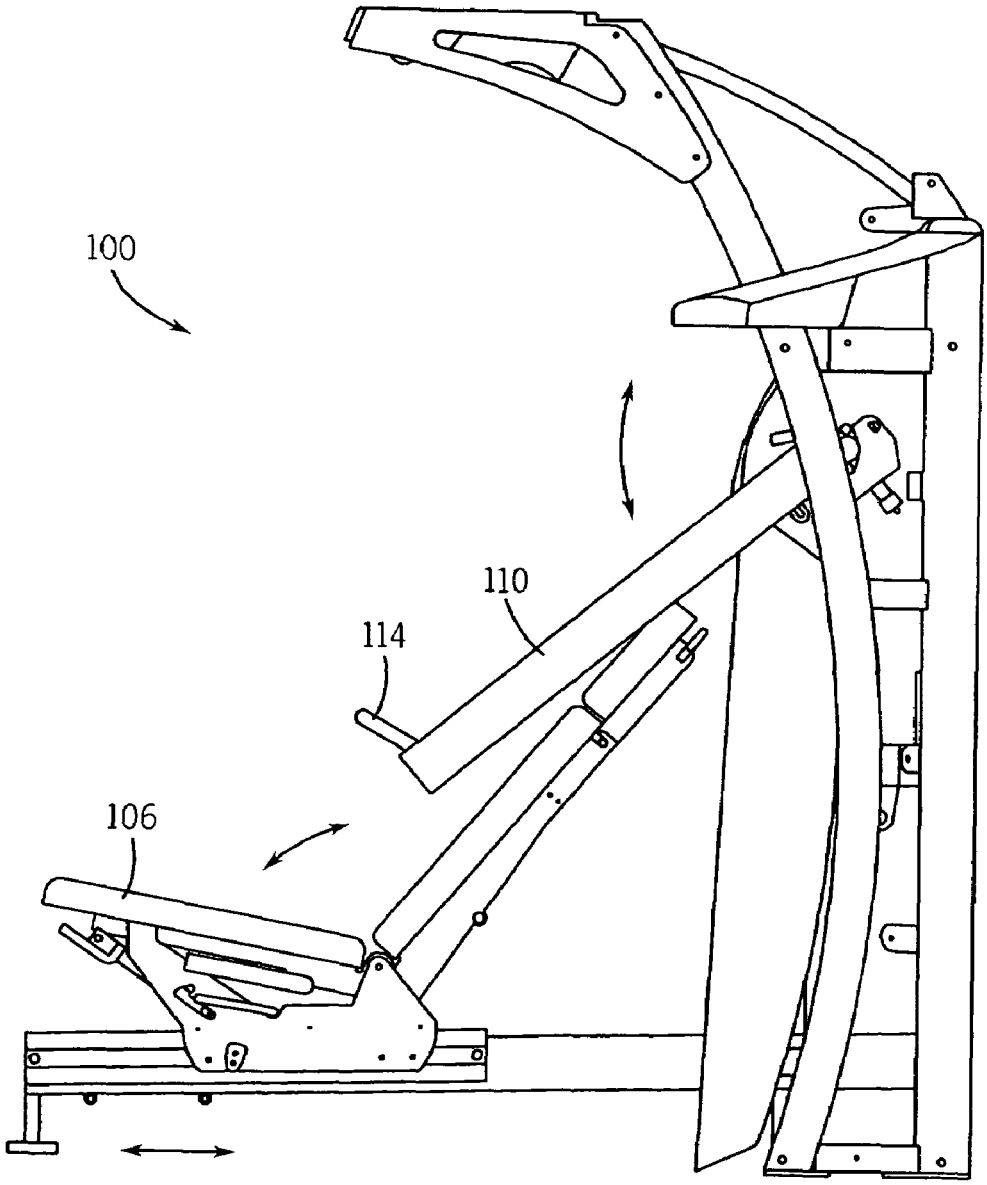
FIG. 9 is a side view of the exercise apparatus in which the press arms are in a second rest position, the handles being suspended at the second elevation above the seat.

The seat 106 and press assembly 104 are adjustable to allow the user to perform a variety of exercises, especially for strengthening the upper torso. For instance, the user may adjust the seat 106 and the press assembly 104 to perform a decline press, bench press, incline press, military press, shoulder press or other exercises known in the art. Further, the press assembly 104 is adjustable to allow the user to alter the rest position of the press arms 108, 110, which in the illustrated embodiment involves adjusting the resting height of the handles 112, 114 relative to the floor, seat or frame. For instance, the user may adjust the press arms 108, 110 from the rest position shown in FIG. 8 to the rest position shown in FIG. 9. Further, the press assembly 104 is adjustable to allow the user to alter the predetermined path that the arms handles 112, 114 will scribe when rotated, such as between predetermined paths 300A, 300B and predetermined paths 302A, 302B depicted in FIG. 6.

Figure 2:
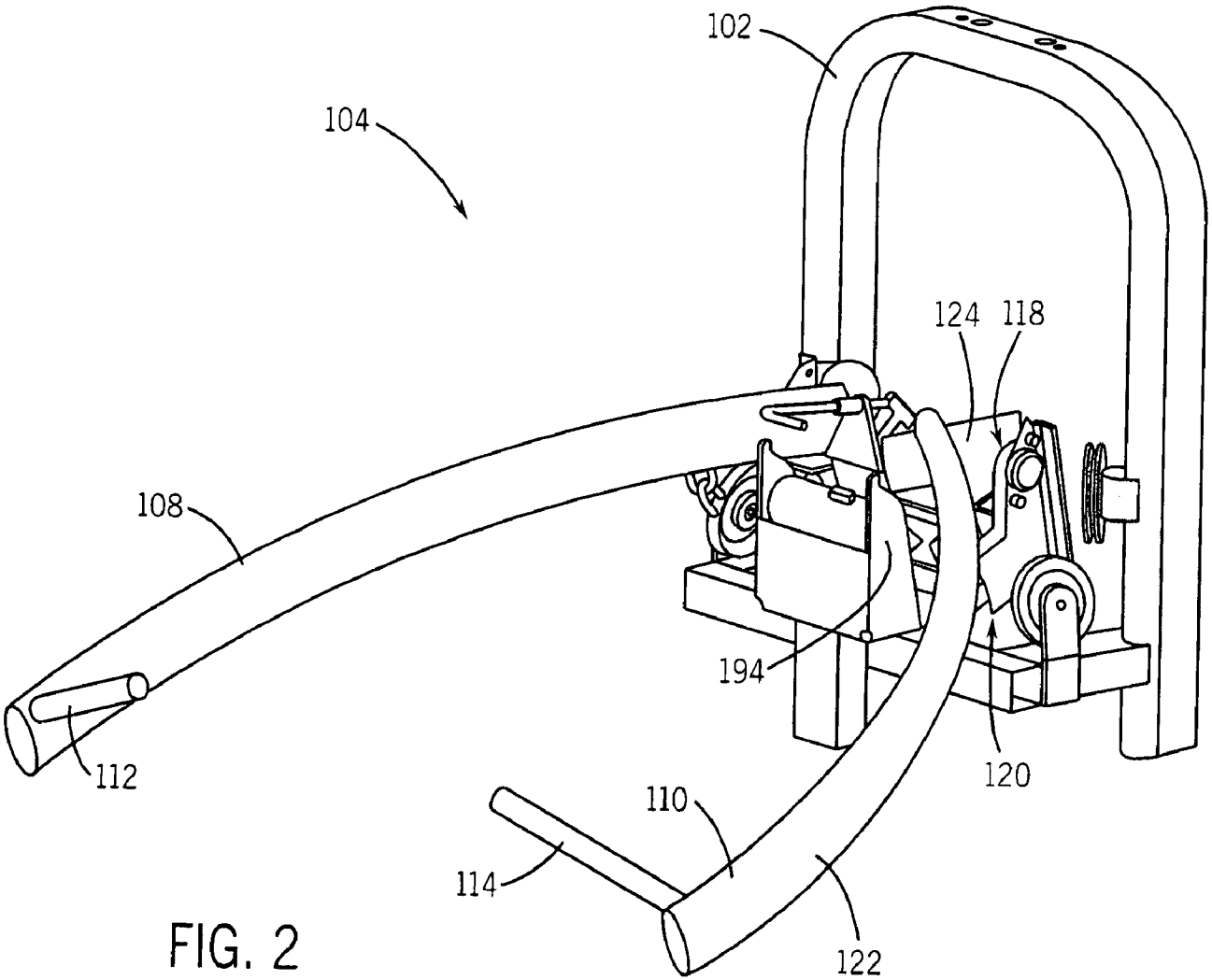
FIG. 2 is a perspective view of aspects of the press assembly depicted in FIG. 1.
Figure 3:
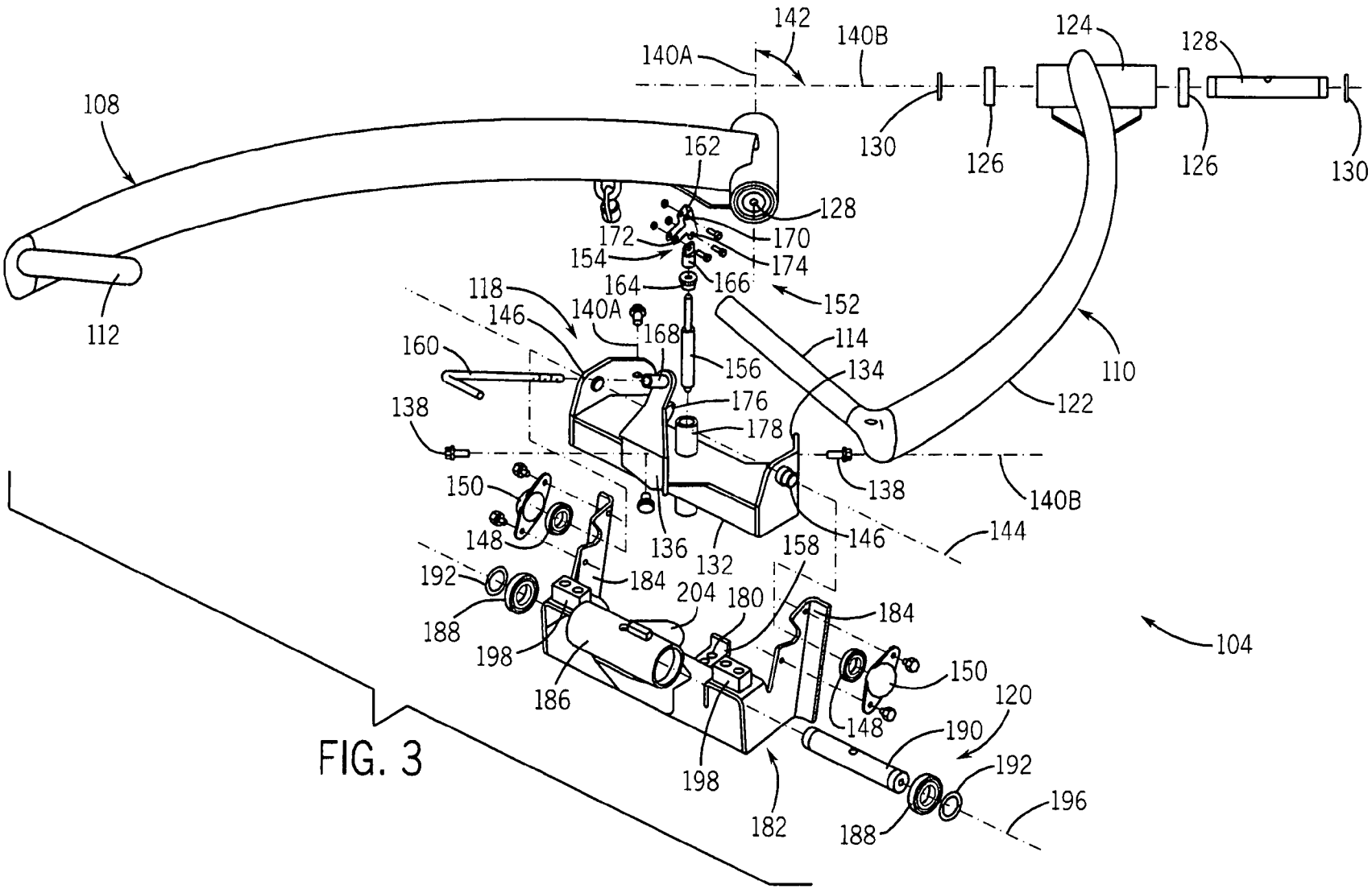
FIG. 3 is an exploded perspective view of the press assembly depicted in FIG. 1.

FIG. 2 shows a perspective view of the press assembly depicted in FIG. 1. FIG. 3 shows an exploded perspective view of the press assembly depicted in FIG. 1. The press assembly 104 includes first and second press arms 108, 110, a support assembly 118, and a rest position assembly 120. In this embodiment, the second press arm 110 is a curved, tubular strut 122 extending between a bearing tube 124. As seen in FIG. 3, the bearing tube 124 is designed to house a pair of press arm pivot bearings 126 which rotatingly receive a press arm pivot axle 128. Retaining rings 130 are placed on the outward facing sides of each press arm pivot bearing 126 to retain the bearing in place. The first press arm 108 is substantially similar in construction to the second press arm 110; therefore, the description above of the second press arm 110 shall be understood as also referring to the first press arm 108.

The press arms 108, 110 are pivotally coupled to the support assembly 118. More specifically, the press arms 108, 110 are pivotally coupled to a weldment 132 that forms part of the support assembly 118. The press arms 108, 110 are coupled to the weldment 132 by fastening the press arm pivot axles 128 to spaced-apart, opposing mounting brackets 134, 136 with fasteners 138 such as a screw. The press arm pivot axles 128 each define a press arm pivot axis 140A, 140B.

In the illustrated embodiment, the pivot axes 140A, 140B are separated by a separation angle 142 from one another as measured in a plane containing both pivot axes 140A, 140B. In the illustrated embodiment, the separation angle is about 90 degrees. Although the pivot axes 140A, 140B are described in the illustrated embodiment as having a specific separation angle 142, other separation angles 142 are suitable for use with and within the scope of the present invention.

The separation angle 142 controls the amount of inward and outward motion that will be experienced by the distal ends of the press arms as they follow their predetermined paths. In the embodiment shown, the separation angle 142 is a fixed amount; however, in an alternative embodiment the angle 142 is adjustable. Increasing the separation angle 142 has the effect of bringing their respective axes toward a more parallel relationship, which effectively decreases the overall lateral distance experienced by the arm ends during use. Decreasing the separation angle 142 has the opposite effect.

In general, the support assembly uses a pin to engage one of a series of adjustment holes, or apertures, in order to orient the support assembly with respect to the rest position assembly. More specifically, the support assembly 118 is pivotally coupled to the rest position assembly 120 about a pivot axis 144. The pivot axis 144 is defined by a pair of stub shafts 146 extending in opposite directions from the weldment 132. The stub shafts 146 are engaged by the rest position assembly 120 via a pair of bearings 148 adapted to rotatingly receive the stub shafts 146. Once the stub shafts 146 are received by the bearings 148, the support assembly 118 is able to rotate about the support assembly pivot axis 144. The bearings 148 are housed within a pair of bearing covers 150 retained in position by fasteners such as screws.

A support assembly adjustment mechanism 152 adjusts the inclination of the support assembly 118 relative to the rest position assembly 120. The support assembly adjustment mechanism 152 includes a linkage group 154, a first locking pin 156, and an adjustment rack 158. The linkage group 154 includes a handle 160, a connecting link 162, a locking pin capture nut 164, and a second locking pin 166, all of which are coupled to the weldment 132. The handle 160 passes through a first support tube 168 coupled to the support assembly 118 and connects to the connecting link 162 at a first mounting aperture 170. The connecting link 162 pivots about its second mounting aperture 172, which is pivotally coupled to a mounting bracket 176 coupled to the support assembly 118. A third mounting aperture 174 of the connecting link 162 is coupled to the second locking pin 166, which is in turn coupled to the first locking pin 156. The first locking pin 156 passes through a second support tube 178 coupled to the support assembly 118. A distal end of the first locking pin 156 selectively engages a plurality of apertures 180 in the adjustment rack 158, which is coupled to the rest position assembly 120.

In operation, the handle 160 is pulled, thereby pivoting the connecting link 162 about its second mounting aperture 172. As the connecting link 162 is pivoted, the second locking pin 166 is pulled upward, thereby pulling the attached first locking pin 156 upward such that the distal end of the first locking pin 156 disengages from one of the apertures 180 in the adjustment rack 158. Once the first locking pin 156 is disengaged from the adjustment rack 158, the support assembly 118 is free to rotate about the support assembly pivot axis 144. Once the support assembly 118 is rotated to a selected inclination relative to the rest position assembly 120, the handle 160 is released such that the distal end of the first locking pin 156 engages one of the apertures 180 of the adjustment rack 158, thereby impeding further rotation of the support assembly 118 relative to the rest position assembly 120. Rotating the support assembly 118 permits a user to adjust the path the handles 112, 114 will scribe when rotated from the rest to the extended positions, as will be discussed in greater detail below.

Turning now to the rest position assembly 120, the rest position assembly 120 includes a press yoke 182. The press yoke 182 includes a pair of upwardly extending arms 184 upon which the previously described bearings 148 and bearing covers 150 are mounted. This provides the pivotal attachment of the support assembly 118 relative to the rest position assembly 120. A bearing tube 186 is coupled to the press yoke 182. The bearing tube 186 is designed to house a pair of pivot bearings 188, which rotatingly receive a pivot axle 190. Retaining rings 192 are placed on the outward facing side of each pivot bearing 188. The pivot axle 190 is coupled to a mounting bracket 194 (see FIG. 1) that is attached to the frame 102, thereby permitting the combination of the rest position assembly 120 and attached support assembly 118 to pivot about a rest position pivot axis 196. Of note, the support assembly pivot axis 144 is oriented substantially parallel with the rest position assembly pivot axis 196. Rotating the rest position assembly 120 permits a user to adjust the location of the rest position of the press arms 108, 110, as will be discussed in greater detail below.

A pair of limit stops 198 are mounted on the press yoke 182. The limit stops 198 of the illustrated embodiment may be made from a resilient material, a few suitable examples being rubber and polyurethane; however, other materials, including nonresilient materials, may be suitably used in the formation of the limit stops, such as metals, woods, springs, air cushions, etc. The limit stops 198 are positioned upon the press yoke 182 so as to bear against the undersides of the press arms 108, 110, to impede the press arms 108, 110 from rotating past a selected position.

Figure 4:
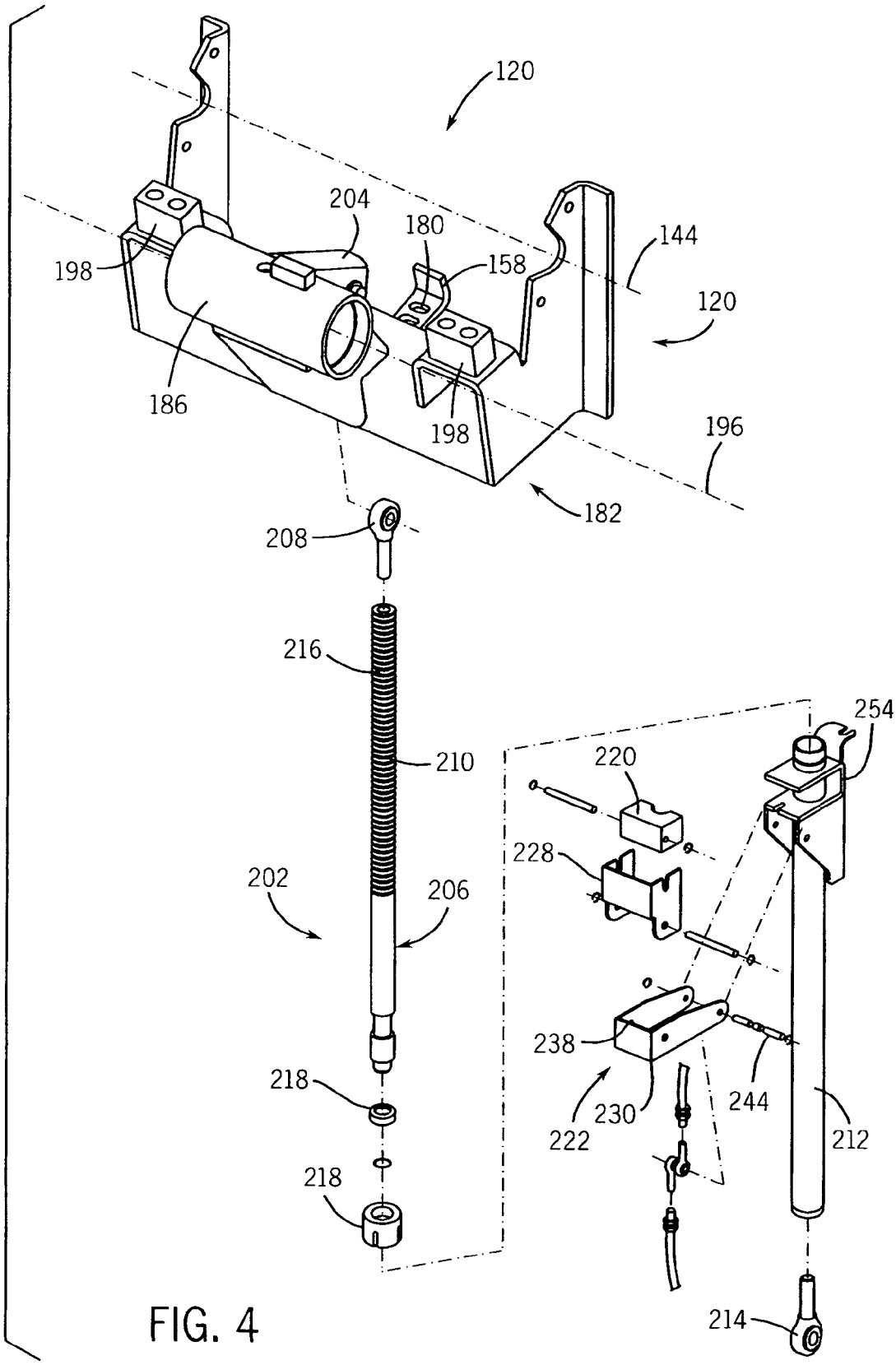
FIG. 4 is an exploded perspective view of the rest position assembly and a rest position adjustment assembly partially depicted in FIG. 1.

FIG. 4 is an exploded perspective view of the rest position assembly and a rest position adjustment assembly partially depicted in FIG. 1. In this embodiment, a telescoping strut is used to control the angular orientation of the rest position assembly. The adjustment mechanism 202 is coupled between the exercise apparatus frame 102 (see FIG. 1) and a clevis 204 carried by the press yoke 182 of the rest position assembly 120. The rest position adjustment mechanism 202 includes a strut 206 that is adjustable in length. Adjusting the length of the strut 206 causes the rest position assembly 120 to rotate about its rest position assembly pivot axis 196 to adjust the starting height of the handles 112, 114 of the press arms 108, 110 when the press arms are in the rest position.

The strut 206 includes a first end connector 208, a threaded rod 210, a receiver tube 212, and a second end connector 214.

The first end connector 208 is attached to a distal (upper) end of the rod 210, and is used to couple the rod 210 to the clevis 204. The rod 210 includes an engagement portion 216 including a plurality of engagement members. In the illustrated embodiment, the engagement members are a plurality of protrusions, and more specifically ACME threads; however, the engagement portion 216 may be formed in alternate manners, e.g., using teeth, dimples, roughened surfaces, holes, pins, recesses, or other such structures that allow a first part to grip or couple to a second part. The rod 210 is slidably receivable within the receiver tube 212 with the aid of a pair of bushings 218. The second end connector 214 is attached to a distal end of the receiver tube 212, and is used to couple the bottom of the receiver tube 212 to the exercise apparatus frame 102.

Figure 5:
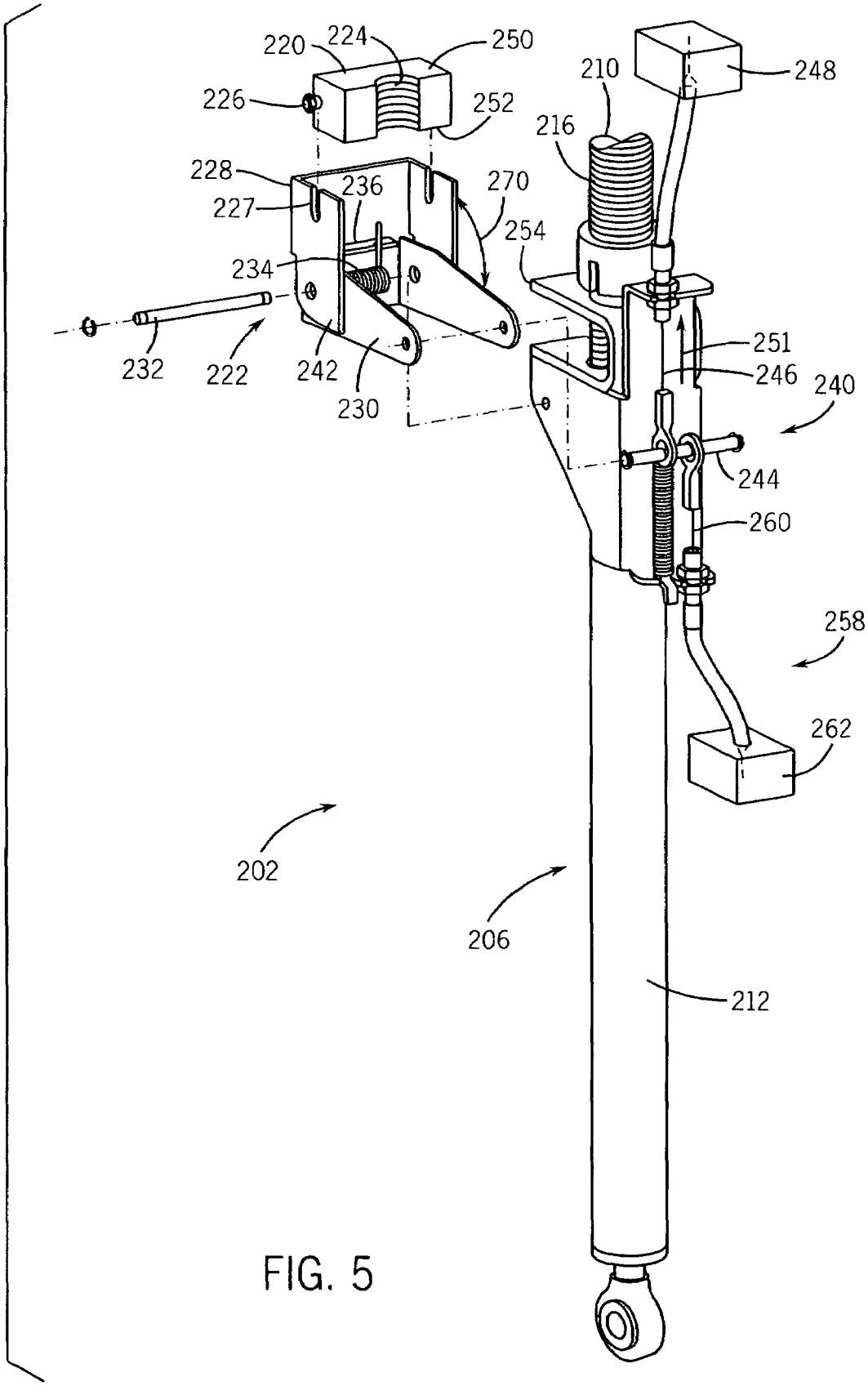
FIG. 5 is a partially exploded perspective view of the rest position adjustment assembly depicted in FIG. 4.

FIG. 5 is a partially exploded perspective view of the rest position adjustment assembly depicted in FIG. 4. The rest position adjustment mechanism 202 includes a locking member 220 such as for example a half nut pinned to a locking member positioning system 222. The locking member 220 may include an engagement portion 224 having a plurality of engagement members adapted to cooperatively engage the engagement portion 216 of the rod 210. In the illustrated embodiment, the engagement portion 224 includes a plurality of protrusions comprising ACME threads; however, the engagement portion 224 may be formed in alternate manners, such as a textured surface which may include teeth, dimples, a roughened surface, holes, a pin or pins, recesses, or other such structures that allow a first part to grip or couple to a second part.

The locking member 220 is pivotally coupled to the locking member positioning system 222 by pins 226 protruding outwardly from the ends of the locking member 220 to engage within slots 227 formed in a locking member bracket 228. The bracket 228 is pivotally coupled to a release bracket 230 by a cross pin 232. The cross pin 232 is also used to couple the locking member positioning system 222 to the strut 206. A biasing device 234, such as a torsion spring, may be engaged over the pin 232 to rotationally bias the locking member bracket 228 away from the release bracket 230. The locking member bracket 228 and the release bracket 230 are disposed relative to each other at a selected separation angle 270. The locking member bracket 228 is impeded from rotating past the separation angle 270, depicted in FIG. 5, by engagement of a lip portion 236 of the locking member bracket 228 with a top edge 238 (see FIG. 4) of the release bracket 230; however, the release bracket 230 is free to rotate toward the locking member bracket 228, i.e., to decrease the separation angle 270, when the biasing force exerted by the biasing device 234 is overcome.

Referring to FIG. 5, a distal end 242 of the release bracket 230 is pivotally coupled to a control assembly 240 by a cross pin 244. The control assembly 240 includes a first cable 246, the distal end of which is anchored to an actuation mechanism 248. The actuation mechanism 248 may be any mechanism operable to impart movement to the first cable 246, such as a handle, solenoid, etc. In the illustrated embodiment and in reference to FIG. 1, a release lever 266 is utilized as the actuation mechanism 248. The release lever 266 is rotatingly mounted upon one of the press arms 108 or 110 such that a user can operate the release lever 266 while gripping its respective handle. The first cable 246 is coupled to the release lever 266, such that when the release lever 266 is actuated by the user, the cable 246 moves in the direction of arrow 251.

When the first cable 246 moves in the direction of arrow 251, the release bracket 230 is rotated toward the locking member bracket 228 so as to decrease the separation angle 270. Due to the biasing device 234, a rotational force is applied to the locking member bracket 228, which applies a disengagement force upon the locking member 220. If the strut 206 is in a substantially nonloaded state, the disengagement force will be sufficient to force the locking member 220 to disengage from the rod 210. However, if the strut 206 is in a loaded state, the disengagement force will be insufficient to overcome the friction forces present between the locking member 220 and the strut 206. More specifically, when the strut 206 is in a loaded condition, either the upper surface 250 or the lower surface 252 (depending on whether the strut is in tension or compression) of the locking member 220 and a locking member receiving bracket 254, coupled to the receiver tube 212, will be loaded against each other, thereby creating friction forces impeding the movement of the locking member 220 away from the strut 206. This system has the benefit of preventing disengagement of the strut while under load, thereby protecting both the user and the machine.

A seat release system 258 is also coupled to the actuation system 248. The seat release system 258 includes an actuation cable 260 and a well-known seat adjustment 262. The seat adjustment mechanism 262 may be actuated by the actuation cable 260 between a locked and unlocked state. When the seat adjustment mechanism 262 is in a locked state, the seat 106 is held in a fixed location. When the seat adjustment mechanism 262 is in an unlocked state, the seat is released and may be moved to another location.

In the illustrated embodiment, when the actuation system 248 is actuated, cable 246 is placed in tension, moving pin 244 in the direction of arrow 251, thereby actuating the release bracket 230 as discussed above. Inasmuch as cable 260 is also coupled to the pin 244, cable 260 is also placed in tension and thereby moved in the direction of arrow 251. Movement of cable 260 in the direction of arrow 251 allows a user to thereby move the location of the seat. Although the seat 106 is shown in different longitudinal positions in FIGS. 8 and 9, it should be apparent to those skilled in the art that the seat 106 may be adjusted in any number of ways, such as by changing the inclination of the back rest 264 of the seat 106.

Figure 6:
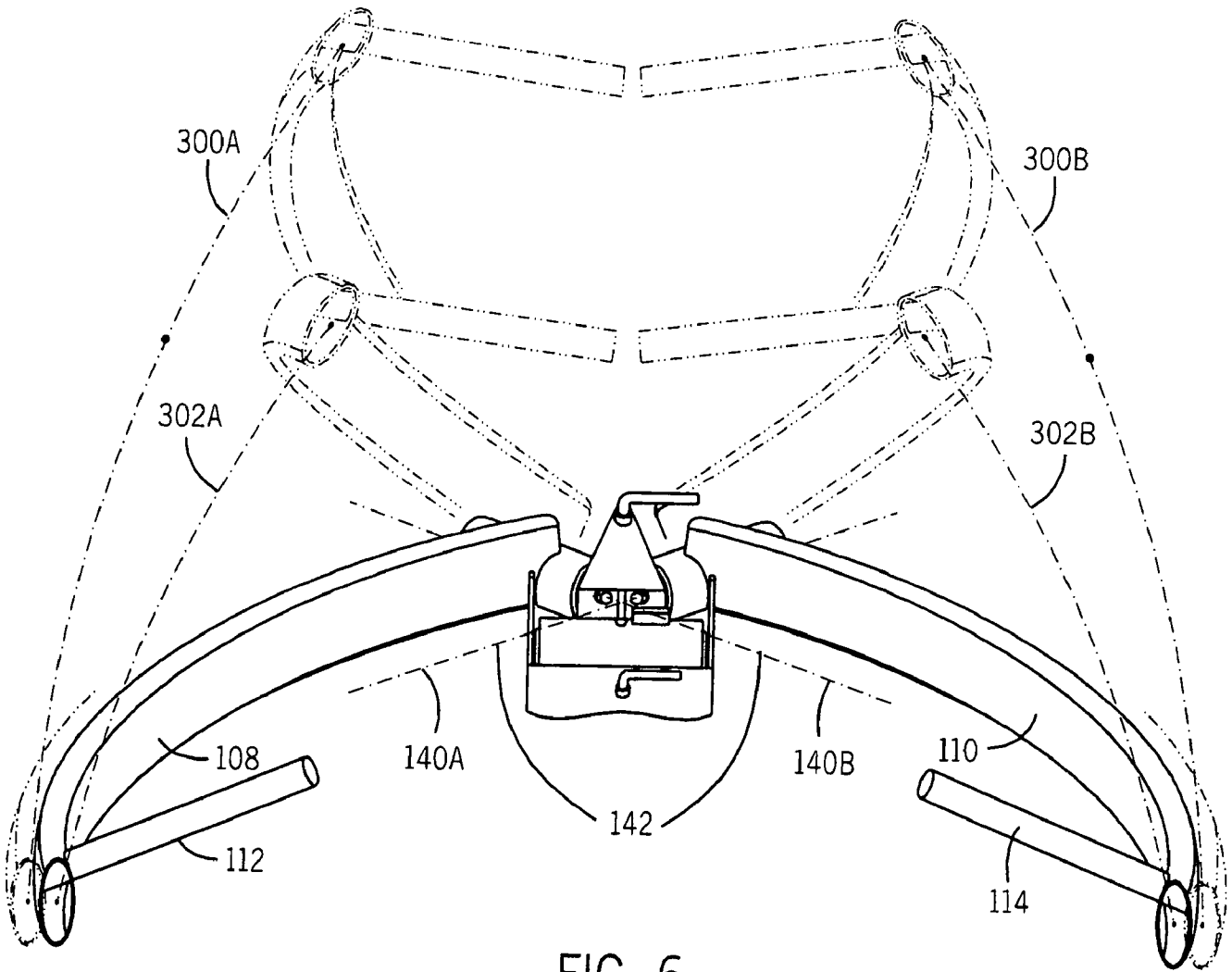
FIG. 6 is a diagrammatic front view of paths taken by two different pairs of press arms as they move from a rest position to an extended position.

Referring now to FIG. 6, the effect of the rotation of the support assembly 118 upon the path of the handles 112, 114 will now be explained. During use, the rotation of the press arms results in the handles following arcuate paths in space. Since the angle 142 between the first press arm pivot axis 140A and the second press arm pivot axis 140B is less than 180 degrees, the combined paths of the press arms result in a shape that is similar to the outline of an orange peel segment, i.e., two arcs touching end to end, though formed in separate planes. During use, the user takes advantage of only a portion of these arcs. Rotation of the support assembly 118 relative to the frame 102 controls which portion is used.

FIG. 6 is a diagrammatic front view of paths taken by two different pairs of press arms as they move from a rest position to an extended position When the support assembly 118 is at a first inclination, the press arms 108, 110 each scribe a first predetermined path 300A, 300B, respectively, when they are rotated about their respective pivot axes 140A, 140B. Also shown in FIG. 6 in phantom lines is the path taken by the arms when the support assembly 118 is rotated downward to a second inclination and the rest position is kept the same as that used for the first inclination. As shown, the resulting paths are the upper regions of the total arcuate paths available.

In selecting which portion of the arcuate paths will be utilized, the user is also deciding how much lateral movement they want to experience during their workout. Thus, by altering the inclination of the support assembly 118 from the first inclination orientation to the second inclination orientation, a user can adjust the path that the press arms 108, 110 will take when rotated, and thereby adjust the exercise to the specific needs of the user.

The rest position assembly 120 controls the starting height of the press arms 108, 110 when in their respective rest positions by controlling the point at which the press arms 108, 110 are engaged by the limit stops 198. As stated above, the limit stops 198, through engagement of the press arms 108, 110, prevent further downward rotation of the press arms 108, 110. By rotating the rest position assembly 120, the selected angle relative to the frame 102 at which the limit stops 198 engage the press arms 108, 110 can adjusted, thereby adjusting the height at which the handles 112, 114 of the press arms 108, 110 are suspended above the floor when in their respective rest positions.

Although a first and a second inclination orientation are described in reference to the rest position assembly 120 of the illustrated embodiment, the rest position assembly 120 may be configured into any number of inclination orientations to provide any number of starting heights when the press arms 108, 110 are in their respective rest positions. Further, although a first and a second predetermined path are described in reference to the illustrated embodiment, the exercise apparatus may be configured into any number of predetermined paths.

Figure 10:
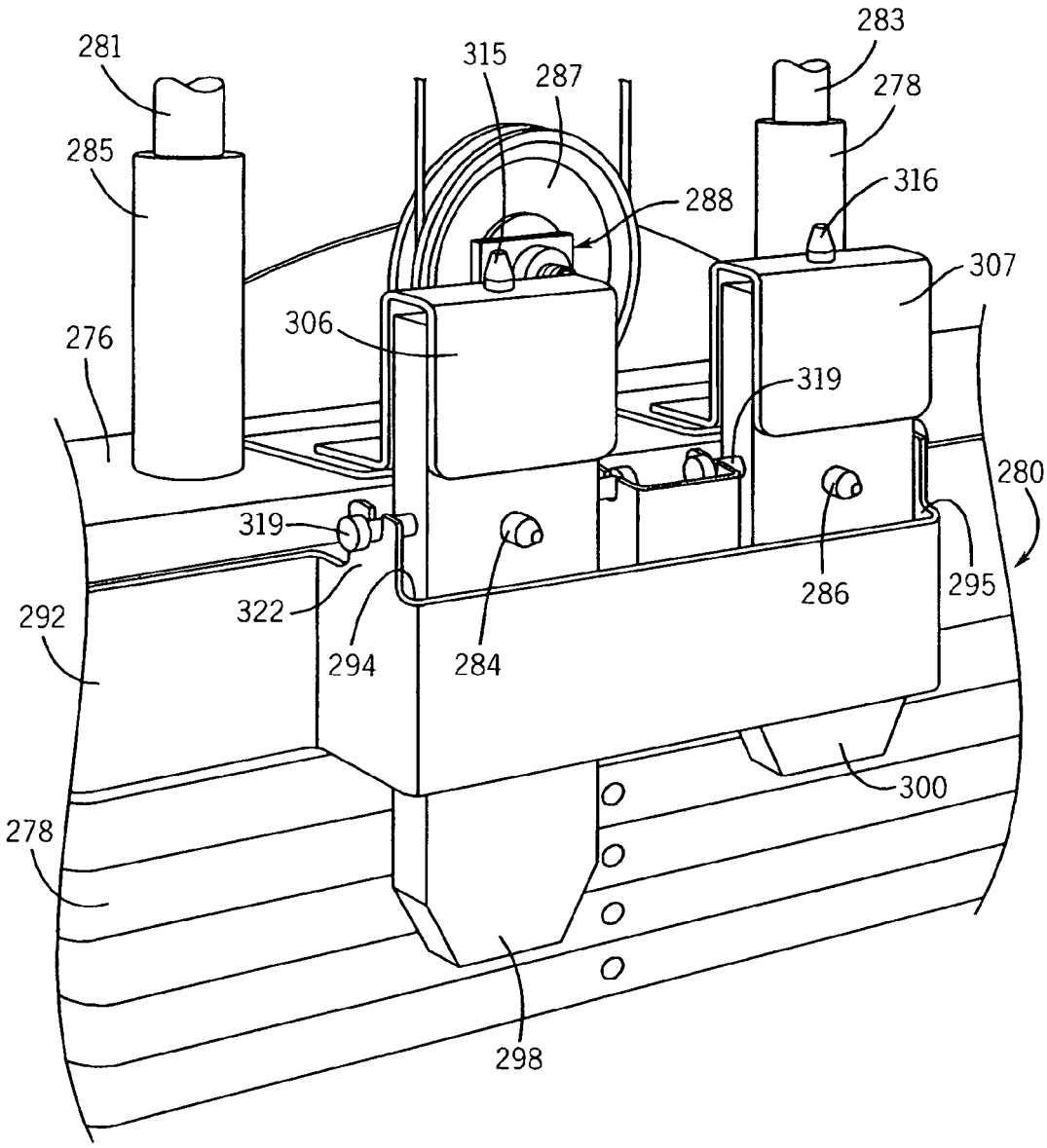
FIG. 10 is a perspective view of the back of the exercise apparatus depicted in FIG. 1 showing a mechanism for add-on weights in accordance with the principles of the present invention.
Figure 11:
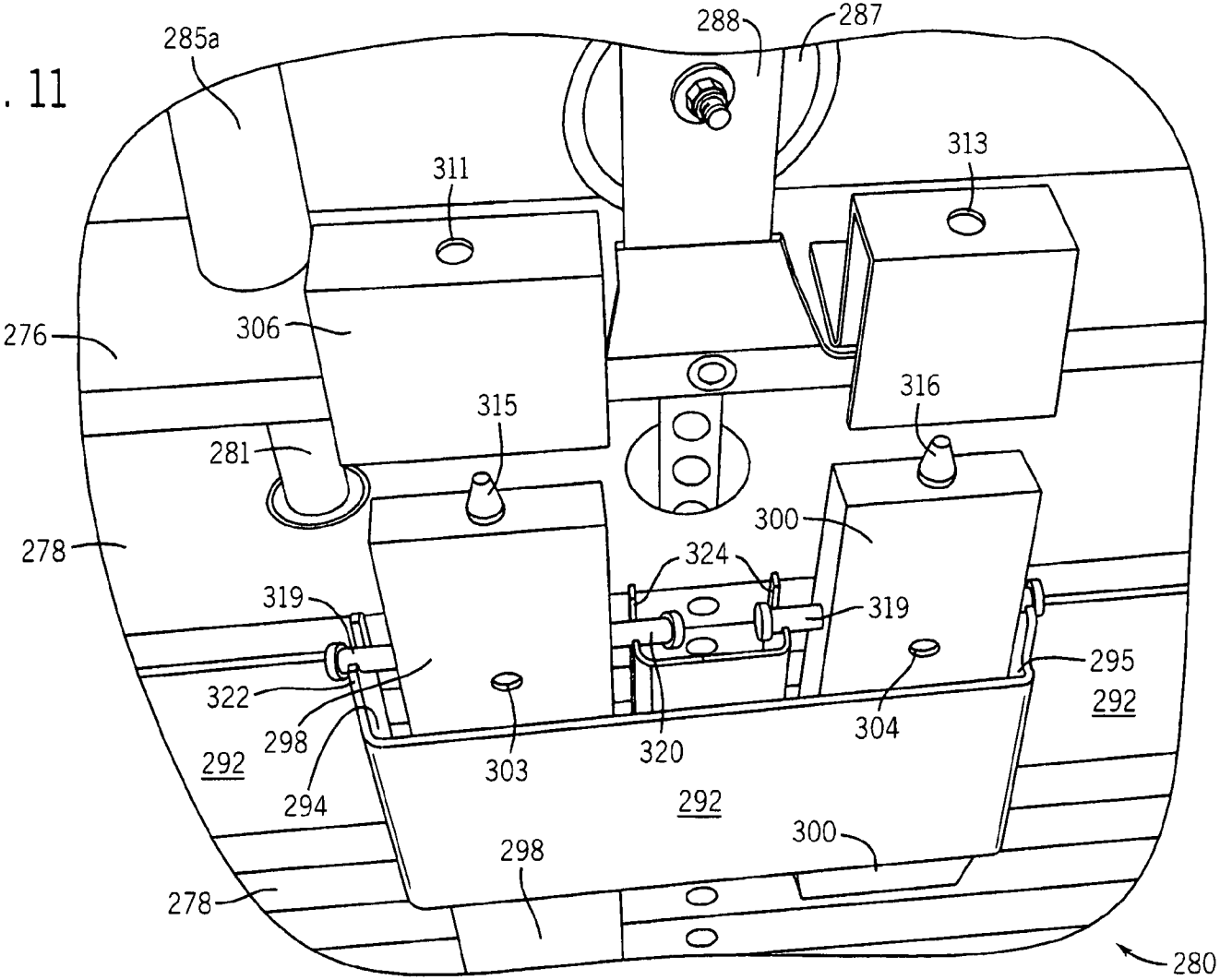
FIG. 11 is an elevated view of the mechanism for add-on weights of FIG. 10.

FIG. 10 is a perspective view of the back of the exercise apparatus depicted in FIG. 1 showing a mechanism for add-on weights in accordance with the principles of the present invention. FIG. 11 is an elevated view of the mechanism for add-on weights of FIG. 10. In the embodiment depicted in FIGS. 10 and 11, the load-bearing assembly 116 (FIG. 1) comprises a first weight 276 and plurality of additional weights 278. While the weights 276, 278 are preferably shown as stacked vertically herein, other orientations are considered within the principles of the present invention.

A combination of the first weight 276 and selected additional weights 278 can be used together in order to provide for different amounts of resistance to the user's rotation of the press arms 108. The weights 276, 278 can be generally rectangular shaped and can define a pair of cooperating vertically oriented apertures (not seen) through which the guide rods 281, 283 extend. While the shape of the weights 276, 278 described herein are generally rectangular, other shapes are considered to be within the principles of the present invention. The additional weights 278 further can define a third vertically oriented, centrally located aperture that includes a horizontally extending branch 325 that extends from front to back of the weight.

The stack of weights 276, 278 are coupled to the press arms 108, 110 (FIG. 1) to provide resistance to the user's rotation of the press arms 108, 110 through a series of cables and pulleys as known in the art. The weights 276, 278 are vertically stacked and are movably mounted to the frame 102 of the exercise apparatus 100 by guiding apparatus, such as for example, the pair of guide rods 281, 283. Bushings 285*a*, 285*b* can be mounted on the first weight 276 to encourage proper alignment of the stack of weights 276, 278 on the guide rods 281, 283. Alterative bushings can also be employed.

A lifting post 277 extends downwardly from the first weight 276 through the vertically oriented, centrally located aperture of the additional weights 278. The lifting post 277 defines a plurality of apertures 279 aligned with the additional weights 278. Thus, the additional weights are accessible from the front of the exercise apparatus via the horizontally extending branch 325. The varying combinations of weights 276, 278 can be selected by the user as known in the art, for example by placing the selector pin 282 (FIG. 1) through the desired branch 325 and the desired aperture 279 to engage the lifting post 277 and thus selecting all of the weights above the selector pin 282. Pin 282 preferably includes at least first and second detents to help to releasably secure the pin into engaged and disengaged positions.

The first weight 276 further includes a cable attachment 288 on the upper surface that connects the first weight 276 to the series of cables and pulleys and thus to the press arms 108, 110. Alternatively, the cable can be coupled to the weights by other means, such as for example directly connected to the upper surface of the weight. As best seen in FIG. 11, in one embodiment the cable attachment 288 on the upper surface of the first weight 276 is attached to a pulley 287 contained in the series of cables and pulleys.

While the embodiment described herein utilizes the selector pin/lifting post arrangement known in the art to select combinations of the first weight and additional weights, various other apparatus can be utilized and be within the scope of the present invention.

As is seen, the first weight 276 and the plurality of additional weights 278 comprise relatively large weights in order to provide a range of flexibility in the amount of weight that can be selected. For example, it is typical for the weights of such exercise apparatus to incorporate 10 lb weight increments. Depending on the particular exercise and user, it is often desirable to select a weight increment that falls between the relatively large weight mass of these weights. Thus, it is known to provide for the addition of add-on weights having weight increments between the weight increments provided for by the exercise apparatus. For example, add-on weights can be provided having increments of, for example, 2.5 lbs, 5 lbs, and 7.5 lbs. Thus, the user is not restricted to choosing weight increments of, in this example, 10 lbs. In accordance with the principles of the present invention, a mechanism for add-on weights 280 is provided.

FIG. 11 is an elevated view of the mechanism for add-on weights 280 of FIG. 10 with the add-on weights 298, 300 depicted in the non-selected position. The mechanism for add-on weights 280 includes an add-on weight support bracket 292 that is secured to the frame 102 of the exercise apparatus 100. The add-on weight bracket 292 defines two weight slots 294, 295. For example, the mechanism for add-on weights 280 of FIG. 10 defines a partially generally U-shaped bracket defining two weight slots 294, 295. Preferably, the add-on weights 298, 300 weigh less than the weight of the weights 276, 278 of such exercise apparatus. For example, in the mechanism for add-on weights 280 of FIG. 10, the weights of such exercise apparatus incorporate 10 lb weight, one add-on weight is 5 lbs, and the second add-on weight is 2.5 lbs. Alternative embodiments cannot only utilize different weights, but also can utilize additional numbers of add-on weights.

Each add-on weight 298, 300 defines an add-on weight selector pinhole 303, 304 as seen in FIG. 11. The first weight 276 further defines a pair of front-to-back oriented apertures (not seen) that extend from front to back of the weight in alignment with each add-on weight selector pinhole 303, 304. Thus, each add-on weight 298, 300 can be added by the user by inserting second and/or third selector pins 284, 286 (FIG. 1) through the front-to-back oriented apertures into alignment with the add-on weight selector pinholes 303, 304, respectively. Like pin 282, pins 284, 286 preferably include detents to help to releasably secure the pins into engaged and disengaged positions. In addition, in the embodiment described herein utilizing two add-on weight 298, 300, the user can select from three additional weight settings by (1) selecting the first add-on weight 298; (2) selecting the second add-on weight 300, or (3) selecting both the add-on weights 298, 300. For example, in the mechanism for add-on weights 280 described herein the user can add 2.5 lbs. (setting (2)), 5 lbs. (setting (1)), or, by selecting both add-on weights 298, 300, 7.5 lbs. (setting (3)).

Thus, if the user desires to use the add-on weights 298, 300, the user utilizes one or both of the add-on weight selector pins 284, 286 to select one or both of the add-on weights 298, 300. The add-on weight selector pins 284, 286 are advantageously positioned to secure the add-on weights 298, 300 at or near their center of gravity. This positioning minimizes swinging and movement of the weights off of its intended path of travel. This positioning is also important because the add-on weights 298, 300 are not always positioned within or under a portion of the add-on weight support bracket 292; when the add-on weights 298, 300 are at the highest position, the add-on weights 298, 300 are not contacting or covered by the bracket 292. Therefore, it is important that the weight remain relatively stable such that it does not bind or otherwise contact the bracket 292 upon its descent back under or within the bracket 292.

The user can thereby add on one or both of the add-on weights 298, 300 without leaving the exercise bench, or lifting and adjusting extra weights. If so selected, an upper periphery of the add-on weights 298, 300 are engaged with add-on weight stabilization brackets 306, 307. The add-on weight stabilization brackets 306, 307 preferably are attached to the first weight 276. The add-on weight stabilization brackets 306, 307 define over add-on weights 298, 300 an upper peripheral aperture 311, 313, respectively. The add-on weight stabilization brackets 306, 307 also inhibit movement of each add-on weight 298, 300 outside of its intended path during use. Specifically, the add-on weight stabilization brackets 306, 307 prevent the lateral and fore and aft movement of each add-on weight 298, 300 relative to the weight stack or frame. Each add-on weight 298, 300 includes extending upwardly therefrom a cooperating add-on weight stabilization member. In the preferred embodiment, the add-on weight stabilization members are add-on weight stabilization pins 315, 316; however, in alternative embodiments, add-on weight stabilization pins 315, 316 can have different shapes, can include more than one pin, or can be removed entirely and replaced by the top portion of the add-on weight having a tapered or narrowed shape that would still engage the stabilization brackets 306, 307.

In addition, each add-on weight 298, 300 defines extending outwardly therefrom a pair of add-on weight support studs 319, 320. The pair of add-on weight support studs 319, 320 act with a pair of generally U-shaped slots 322, 324 defined in the add-on weight support bracket 292 to support the add-on weights 298, 300 when not selected, as shown in FIG. 11. Other stabilizing arrangements are within the principles of the present invention.

Thus, if an add-on weight 298 is selected, the weight selector pin 284 captures the add-on weight 298 in the add-on weight stabilization bracket 306. With the cooperating weight slot 294, the add-on weight stabilization bracket 306 acts to cradle the weight in a secure orientation. The add-on weight stabilization pin 315 extends upwardly from the add-on weight 298 into the cooperating upper peripheral aperture 311 defined in the add-on weight stabilization bracket 306. This adds a second region of contact for the add-on weight 298 that keeps the add-on weight 298 from moving front-to-back and side-to-side. The second add-on weight 300 is likewise secured when selected by the user. In addition, both add-on weights 298, 300 can be likewise secured if selected by the user.

While the embodiment described herein utilizes the selector pin/lifting post arrangement known in the art to select combinations of the add-on weights, various other apparatus can be utilized and be within the scope of the present invention.

Thus, a mechanism for add-on weights in accordance with the principles of the present invention adds weight with sufficient support to minimize movement during the exercise routine and preclude lost weights. A mechanism for add-on weights in accordance with the principles of the present invention does not upset of the balance of the weights of such exercise apparatus with respect to the mechanisms that connect the weights to the user. In addition, a mechanism for add-on weights in accordance with the principles of the present invention does not use add-on weights that are guided in a track that can alter the applied weight to the user. Still further, a mechanism for add-on weights in accordance with the principles of the present invention achieves these advantages without use of costly, complicated structure.

Figure 7:
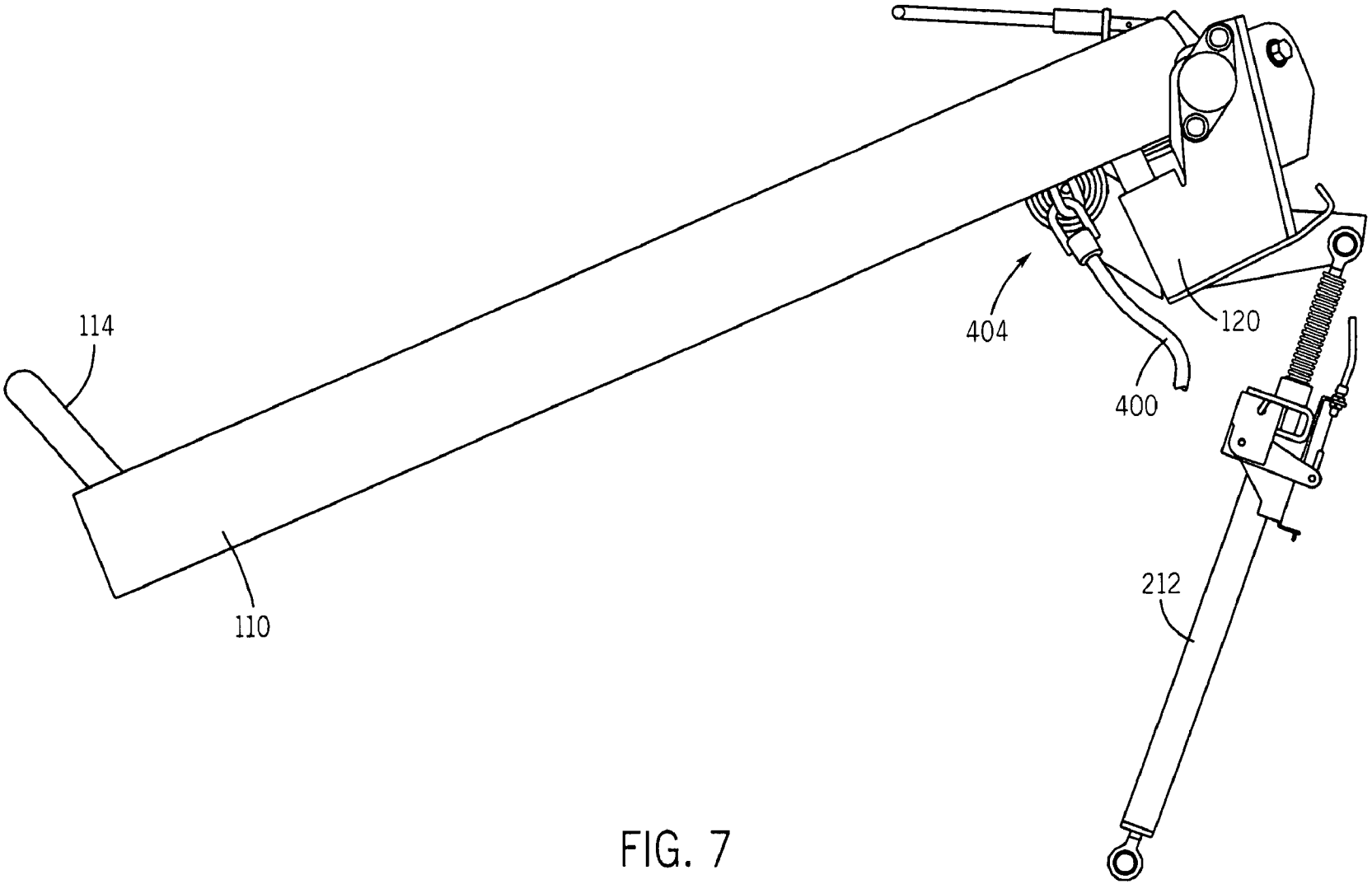
FIG. 7 is a side elevation view of the press assembly shown in FIG. 1 and the rest position assembly and rest position adjustment assembly depicted in FIG. 4.

Referring back to FIGS. 1, 8 and 9, during use of the exercise apparatus 100, a person sits on seat 106 and activates the control assembly 240 to position the user a comfortable distance from the handles. Simultaneously, the person rotates the rest position assembly and thereby positions the handles at a comfortable height. Should the user desire a different amount of lateral movement, the user can adjust the support assembly by repositioning the first locking pin 156 in a different aperture 180. The user can then move one or both arms to perform the desired workout. Resistance is provided in each arm by a cable 400 that attaches to the load-bearing assembly 116. FIG. 7 is a side elevation view of the press assembly shown in FIG. 1 and the rest position assembly and rest position adjustment assembly depicted in FIG. 4. The cable 400 is connected to the lower surface of arm 110 by a shackle 404. This connection can preferably be positioned at a location in line with the rest position assembly pivot axis 196. Doing so allows the rest position to be adjusted without affecting the required length of the cable. A similar arrangement is provided for arm 108.

While the preferred embodiment of the invention has been illustrated and described, it will be appreciated that various changes can be made therein without departing from the spirit and scope of the invention. For example, while the embodiment described herein was a press station, the principles of the present invention encompass other type of exercise equipment as well. Accordingly, it will be intended to include all such alternatives, modifications and variations set forth within the spirit and scope of the appended claims.

What is claimed is:

1. An exercise apparatus comprising:

a frame with a support point;

a stack of weights comprising a first weight and plurality of additional weights, wherein the first weight includes a first selector pin aperture extending along a first axis in a first direction and wherein each of the plurality of additional weights including a second selector pin aperture extending in the first direction;

a lifting post extending along each of the plurality of additional weights including a plurality of second selector pin apertures spaced along the lifting post and aligned with the second selector pin apertures;

a load-bearing assembly connected to the frame;

an adjustment mechanism for altering the orientation of the load-bearing assembly relative to the support point; and a mechanism that adds-on at least one additional load, wherein the load adding mechanism comprises:

a first add-on weight, the first add-on weight having a first region of contact; and a stabilization bracket defining a second region of contact for the first add-on weight, wherein the first region of contact for the first add-on weight comprises a selector pin hole defined in the first add-on weight and adapted to receive a selector pin, wherein the selector pin hole is in alignment with the first selector pin aperture and extends in the first direction.

2. The exercise apparatus of claim 1, wherein the adjustment mechanism comprises:

a telescoping strut including an exposed end region and a distal end, the exposed end region being connected to the load-bearing assembly;

a receiver tube having a proximal end and a distal end connected to the support point; the strut being adjustably positioned within the receiver tube through its proximal end;

a locking member adapted to engage the strut exposed end region; and a locking member positioning system that selectively releases the engagement of the locking member from the strut; wherein release is possible when the strut is not experiencing a load; when the strut is experiencing a load, the locking member continues engagement with the strut.

3. The exercise apparatus of claim 1 further including an add-on weight support bracket secured to the exercise apparatus, the add-on weight support bracket defining an add-on weight slot, the add-on weight slot acting with the stabilization bracket to cradle at least a portion of the first weight when the selector pin is received by the add-on weight selector pin hole.

4. The exercise apparatus of claim 1, wherein the first add-on weight includes a stabilization pin and the second region of contact for the at least one add-on weight comprises a completely bounded bracket hole formed by the stabilization bracket and into which the stabilization pin extends.

5. The exercise apparatus of claim 1, wherein the load adding mechanism includes a second add-on weight, and wherein the user can select from three additional weight settings by selecting the first add-on weight, selecting the second add-on weight or selecting both the first and second add-on weights.

6. The exercise apparatus of claim 5, wherein the exercise apparatus includes a stack of weights comprising a first weight and plurality of additional weights, and further wherein the user can select additional weight settings via a selector pin hole in the add-on weights accessible through an aperture defined in the first weight.

7. The exercise apparatus of claim 1, wherein the stabilization bracket moves with the first add-on weight during lifting of the first add-on weight when a selector pin is inserted in the first selector pin aperture and in the selector pin hole and wherein the stabilization bracket moves away from the first add-on weight during lifting of the first weight when the selector pin is withdrawn from the first selector pin aperture and the selector pin hole.

8. A mechanism for add-on weights in an exercise apparatus comprising:

a stack of weights comprising a first weight and plurality of additional weights;

a selector pin;

a first add-on weight including a stabilization member, the first add-on weight further defining a selector pin hole adapted to receive the selector pin, wherein the selector pin hole is accessible through an aperture defined in the first weight;

a stabilization bracket adapted to capture at least a portion of the first add-on weight and to vertically move with the first add-on weight during lifting of the first weight when the selector pin is received by the selector pin hole and to move independent of the first add-on weight during lifting of the first weight when the selector pin is withdrawn from the selector pin hole; and the stabilization bracket further configured to engage the stabilization member.

9. The mechanism for add-on weights of claim 8 further including an add-on weight support bracket secured to the exercise apparatus, the add-on weight support bracket defining an add-on weight slot, the add-on weight slot acting with the stabilization bracket to cradle the weight when the selector pin is received by the add-on weight selector pin hole.

10. The mechanism for add-on weights of claim 8, further including a lifting post extending downwardly from the first weight through an aperture defined in the additional weights.

11. The mechanism for add-on weights of claim 8, further including a second add-on weight, and wherein the user can select from three additional weight settings by selecting the first add-on weight, selecting the second add-on weight or selecting both the first and second add-on weights.

12. The mechanism for add-on weights of claim 8, further wherein the stabilization member comprises a stabilization pin; and the stabilization bracket further defines an aperture into which the stabilization pin extends when the selector pin is received by the selector pin hole.

13. The exercise device of claim 8 further comprising a lifting post including a plurality of apertures spaced along the post and extending through the post in a first direction, wherein the selector pin hole extends into the first add-on weight in the first direction.

14. An exercise apparatus comprising:

a frame;

a stack of main weights including a first main weight movably coupled to the frame;

a cable connected to the first weight;

a first add-on weight;

a first selector pin extending along a first axis and movable between a first position in which the first selector pin couples the first add-on weight to the cable such that the first add-on-weight is liftable with the cable and a second position in which the add and-on weight is decoupled from the cable;

a first stabilization bracket coupled to the first main weight, wherein one of the bracket and the add-on weight includes a first projection and the other of the bracket and the add-on weight includes a first detent configured to removably receive the projection, the first projection and the first detent extending along a second axis substantially perpendicular to the first axis;

a second add-on weight;

a second selector pin extending along a third axis and movable between a third position in which the second selector pin couples the second add-on weight to the cable such that the second add-on-weight is liftable with the cable and a fourth position in which the add-on weight is decoupled from the cable;

a second stabilization bracket coupled to the first main weight, wherein one of the second bracket and the second add-on weight includes a second projection and the other of the bracket and the second add-on weight includes a second detent configured to removably receive the second projection, the second projection and the second detent extending along a fourth axis of substantially perpendicular to the third axis, wherein a user may select from three additional weight settings by selecting the first add-on weight, selecting the second add-on weight or selecting both the first add-on weight and the second add-on weight by moving the first selector pin between the first and second positions and the second selector pin between the third and fourth positions.

15. The exercise apparatus of claim 14, wherein the first stabilization bracket extends on opposite sides of the add-on weight so as to sandwich the first add-on weight.

16. The exercise apparatus of claim 14 further comprising:

a support bracket stationarily fixed to the frame, the support bracket including a slot; and a protuberance extending from the first add-on weight and configured to be received within the slot while the first selector pin is in the second position to support the first add-on weight while the first weight is being lifted.

17. The exercise apparatus of claim 16, wherein the protuberance extends along a fifth axis substantially perpendicular to the first axis and the second axis.

18. The exercise apparatus of claim 14 further comprising:

a first support bracket stationarily fixed to the frame and configured to retain the first add-on weight against movement along the first axis while permitting the first add-on weight to be lifted along the second axis and to be completely disconnected from a first support bracket and the first stabilization bracket without use of tools.

19. The exercise apparatus of claim 18 further comprising:

a second support bracket stationarily fixed to the frame and configured to retain the second add-on weight against movement along the third axis while permitting the second add-on weight to be lifted along the fourth axis and to be completely disconnected from a second support bracket and the second stabilization bracket without use of tools.

20. The exercise apparatus of claim 14, wherein the first add-on weight includes a first selector pin aperture receiving the first selector pin when the first selector pin is in the first position, wherein the first weight includes a second selector pin aperture in alignment with the first selector pin aperture and wherein the first selector pin extends through the second selector pin aperture of into the first selector pin aperture when in the first position.

* * * * *